US009258071B1

(12) United States Patent
Uden et al.

(10) Patent No.: US 9,258,071 B1
(45) Date of Patent: Feb. 9, 2016

(54) WIRELESS COMMUNICATION SESSION INITIATION BASED ON A FREQUENCY MODULATION (FM) RADIO DATA SERVICE (RDS)

(71) Applicant: Sprint Communications Company L.P., Overland Park, KS (US)

(72) Inventors: Jeffrey Lee Uden, Olathe, KS (US); Shane R. Werner, Olathe, KS (US); Eric Michael Bloomcamp, Olathe, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 87 days.

(21) Appl. No.: 14/147,967

(22) Filed: Jan. 6, 2014

(51) Int. Cl.
*H04H 20/38* (2008.01)
*H04H 60/33* (2008.01)

(52) U.S. Cl.
CPC ..... *H04H 20/38* (2013.01); *H04H 60/33* (2013.01); *H04H 2201/13* (2013.01); *H04H 2201/30* (2013.01)

(58) Field of Classification Search
CPC ... H04H 20/93; H04H 2201/13; H04H 60/33; H04H 2201/33; H04H 2201/30; H04N 21/4722
See application file for complete search history.

(56) References Cited

U.S. PATENT DOCUMENTS

| | | | | |
|---|---|---|---|---|
| 6,628,928 | B1 | 9/2003 | Crosby et al. | |
| 8,310,985 | B2 | 11/2012 | Harb | |
| 2006/0141962 | A1 * | 6/2006 | Forbes et al. | 455/186.1 |
| 2009/0239557 | A1 * | 9/2009 | Kadakia et al. | 455/466 |

FOREIGN PATENT DOCUMENTS

| | | |
|---|---|---|
| EP | 1100031 | 5/2001 |

* cited by examiner

*Primary Examiner* — Bobbak Safaipour
*Assistant Examiner* — Devan Sandiford

(57) ABSTRACT

A wireless communication system wirelessly receives a Frequency Modulation (FM) signal including audio data and Radio Data System (RDS) data. The wireless communication system audibly plays the audio data and graphically displays the RDS data from the FM signal. The wireless communication system detects action codes in the RDS data, and in response, initiates a wireless communication session with a wireless communication network. The wireless communication system also audibly captures user data. The wireless communication system then wirelessly transfers the captured user data for delivery to a server over the wireless communication session.

16 Claims, 5 Drawing Sheets

WIRELESS COMMUNICATION SESSION INITIATION BASED ON A FREQUENCY MODULATION (FM) RADIO DATA SERVICE (RDS)

TECHNICAL BACKGROUND

Frequency Modulation (FM) broadcasts transport content, such as music, news, sports, and the like. The FM broadcasts also transport Radio Data System (RDS) data that include data items, such as the time, station call letters, broadcast frequency, station content, song title, song artist, and advertisement text. FM radios decode and display the RDS data to accompany the playing of the audio content.

Vehicles are increasingly receiving computer and communication systems to provide hands-free control to the vehicle operator. The hands-free operation may include an audio control interface for the user, as well as, graphical displays and the like. For example, a user may use spoken commands to operate their phone while driving to place and answer calls in a hands-free manner.

Unfortunately, the FM radios and the vehicle control systems are not effectively and efficiently coordinated for an optimal user experience that enhances safety while allowing robust user interaction with an FM radio program.

TECHNICAL OVERVIEW

A wireless communication system wirelessly receives a Frequency Modulation (FM) signal including audio data and Radio Data System (RDS) data. The wireless communication system audibly plays the audio data and graphically displays the RDS data from the FM signal. The wireless communication system detects action codes in the RDS data, and in response, initiates a wireless communication session with a wireless communication network. The wireless communication system also audibly captures user data. The wireless communication system then wirelessly transfers the captured user data for delivery to a server over the wireless communication session.

DETAILED DESCRIPTION

Figure 1:
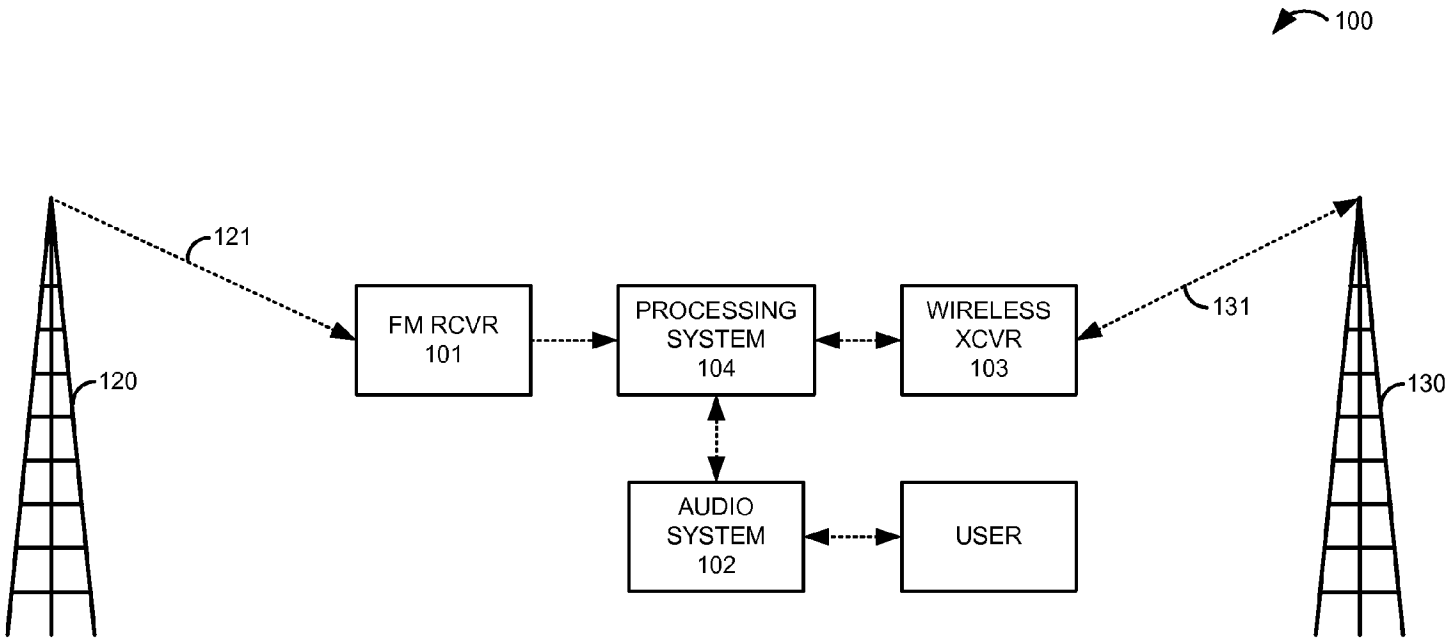
FIG. 1 illustrates a wireless communication system to initiate wireless communications sessions based on FM RDS data.

FIG. 1 illustrates wireless communication system 100 to initiate wireless communications sessions based on a Frequency Modulation (FM) Radio Data System (RDS) signal. Wireless communication system 100 comprises: FM receiver 101, audio system 102, wireless transceiver 103, and processing system 104. Typically, wireless communication system

100 is integrated within a vehicle or comprises a computer and communication system that is transported by a vehicle. User devices, such as phones, media players, and tablet computers, may be integrated into wireless communication system 100.

In operation, FM receiver 101 wirelessly receives Frequency Modulation (FM) signal 121 from FM transmitter 120. FM signal 121 includes both audio data and RDS data. FM receiver 101 decodes and transfers the audio data and the RDS data to processing system 104. Processing system 104 transfers the audio data and the RDS data to audio system 102. Audio system 102 audibly plays the audio data and graphically displays the RDS data. For example, audio system 102 may play a song from its speakers while identifying the FM station, artist, and song title on a graphic display.

Processing system 104 also processes the RDS data from FM signal 121 to detect one or more action codes. An action code comprises a data set that is distinguishable from other RDS data and that is associated with an instruction set within processing system 104. An exemplary action code might be the text sequence "!!34df!!sfb##$sd345." The action codes may be relatively simple or have a complex syntax of code type, code task, security data, and the like. Processing system 104 maintains logic and data to authorize and translate the RDS action codes into executable computer instructions.

In response to detecting one or more action codes, processing system 104 initiates wireless communication session 131 with wireless communication network 130 through wireless transceiver 103. Processing system 104 also directs audio system 102 to capture spoken user data. In response, wireless transceiver 103 establishes communication session 131 with wireless communication network 130 and audio system 102 captures user data in the form of spoken audio. Processing system 104 then directs wireless transceiver 103 to transfer the captured user audio data to a server over wireless communication session 131. In some cases, processing system 104 processes the RDS data to identify source and/or destination Internet Protocol (IP) addresses for an IP message containing the spoken user data. Communication session 131 uses a wireless communication protocol, such as Long Term Evolution (LTE), Evolution-Data Optimized (EVDO), High Speed Packet Access (HSPA), Wireless Fidelity (Wi-Fi), or some other wireless format.

Although there are various uses for communication system 100, some examples allow a broadcast FM radio station to interact safely with the operator of a vehicle by prompting listeners of the FM broadcast and initiating contemporaneous audio-capture and wireless transfer of their spoken user responses. For example, a radio DJ may request traffic reports in their FM broadcast signal from drivers who can safely and dynamically respond with live audio feedback. Note that various security features, such as biometric user validation and FM frequency screening, could be implemented as desired.

Figure 2:
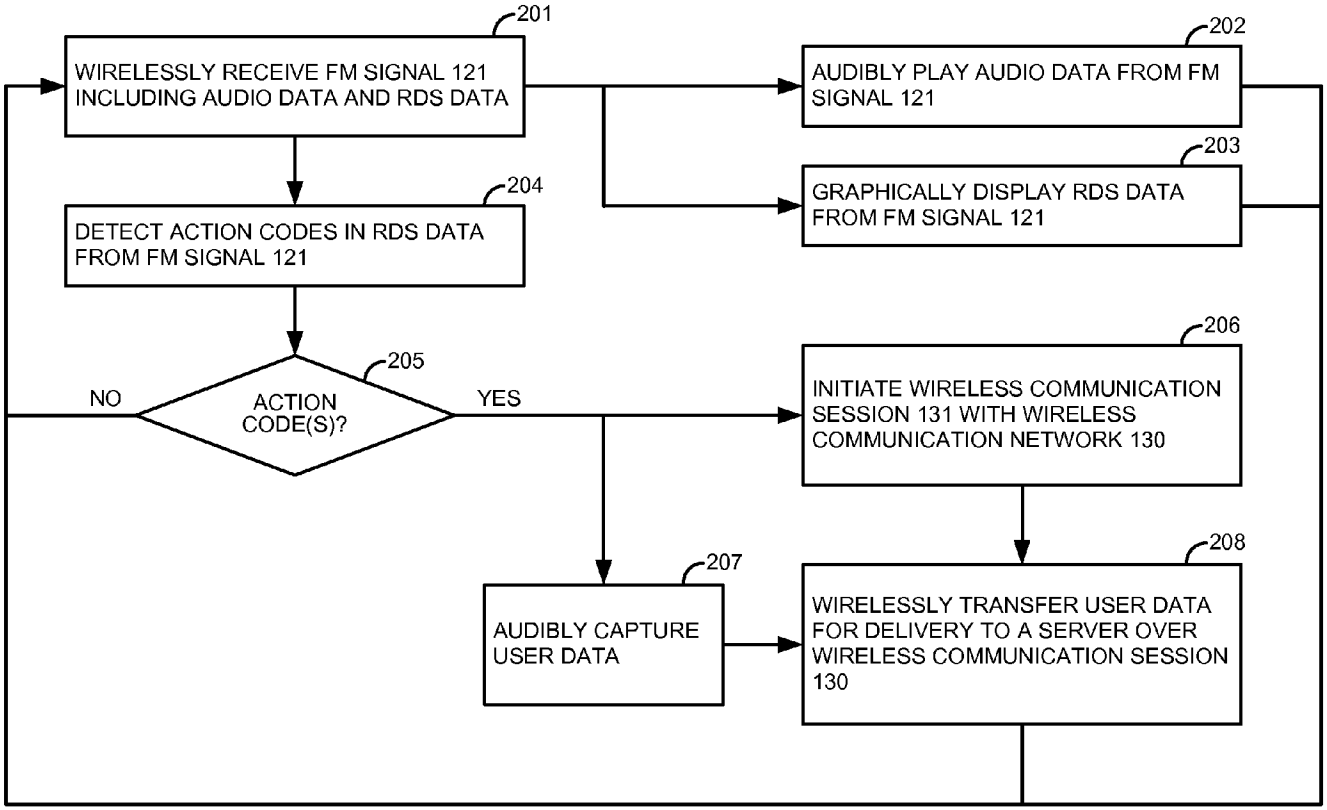
FIG. 2 illustrates the operation of a wireless communication system to initiate wireless communications sessions based on FM RDS data.

FIG. 2 illustrates the operation of wireless communication system 100 to initiate wireless communications sessions based on FM RDS data. Wireless communication system 100 wirelessly receives FM signal 121 that includes both audio data and RDS data (201). Wireless communication system 100 audibly plays the audio data (202). Wireless communication system 100 graphically displays the RDS data (203). For example, audio system 102 may play a song from its speakers while identifying the FM station, artist, and song title on a graphic display.

Wireless communication system 100 also processes the RDS data from FM signal 121 to detect one or more action codes (204). There could be many different actions codes that trigger various actions. In response to detecting particular action codes (205), wireless communication system 100 initiates wireless communication session 131 with wireless communication network 130 (206) and captures spoken user data (207). Wireless communication system 100 then transfers the captured user data to a server over wireless communication session 131 (208).

Figure 3:
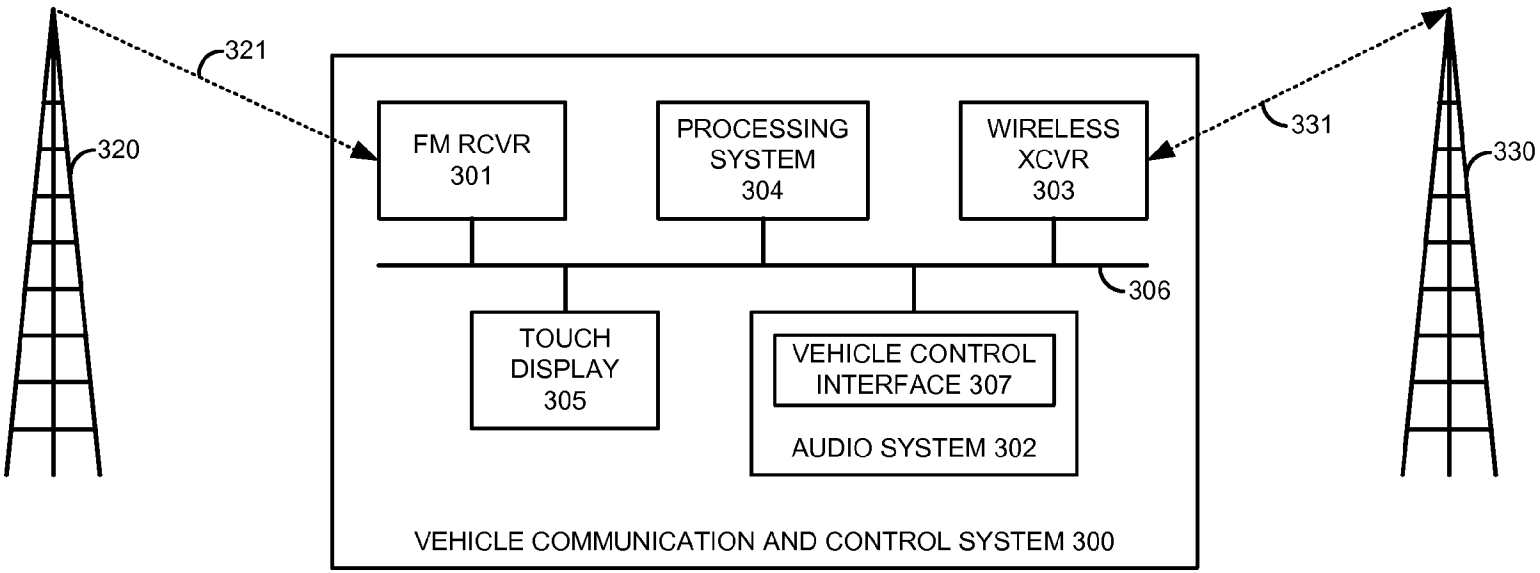
FIG. 3 illustrates a vehicle communication and control system to initiate wireless communications sessions based on FM RDS data.

FIG. 3 illustrates vehicle communication and control system 300 to initiate wireless communications sessions based on FM RDS data. Vehicle communication and control system 300 comprises: FM receiver 301, audio system 302, wireless transceivers 303, processing system 304, touch display 305, and communication electronics 306. Audio system 302 includes vehicle control interface 307 that audibly interacts with a human operator to provide hands-free control of the vehicle. Vehicle control interface 307 typically comprises speakers, microphones, electronics, and associated components—including biometric security systems.

In operation, FM receiver 301 wirelessly receives FM signal 321 from FM transmitter 320. FM signal 321 includes both audio data and RDS data. FM receiver 301 decodes and transfers the audio data and the RDS data to processing system 304. Processing system 304 transfers the audio data to audio system 302 and transfers the RDS data to touch display 305. Audio system 302 audibly plays the audio data and touch display 305 graphically displays the RDS data. For example, audio system 302 may play a song from its speakers while touch display 305 graphically presents the FM station, artist, and song title.

Processing system 304 also processes the RDS data from FM signal 321 to detect action codes. An action code is distinguishable from other RDS data and is associated with an instruction set in processing system 304. In response to one action code, processing system 304 directs wireless transceiver 303 to establish wireless communication session 331 with wireless communication network 330. In response to that action code or another, processing system 304 directs audio system 302 to capture spoken user data. In response to these directions, wireless transceiver 303 establishes communication session 331 with wireless communication network 330 and audio system 302 captures user data in the form of spoken audio. Processing system 304 then directs wireless transceiver 303 to transfer the captured user audio data to a server over wireless communication session 331.

Figure 4:
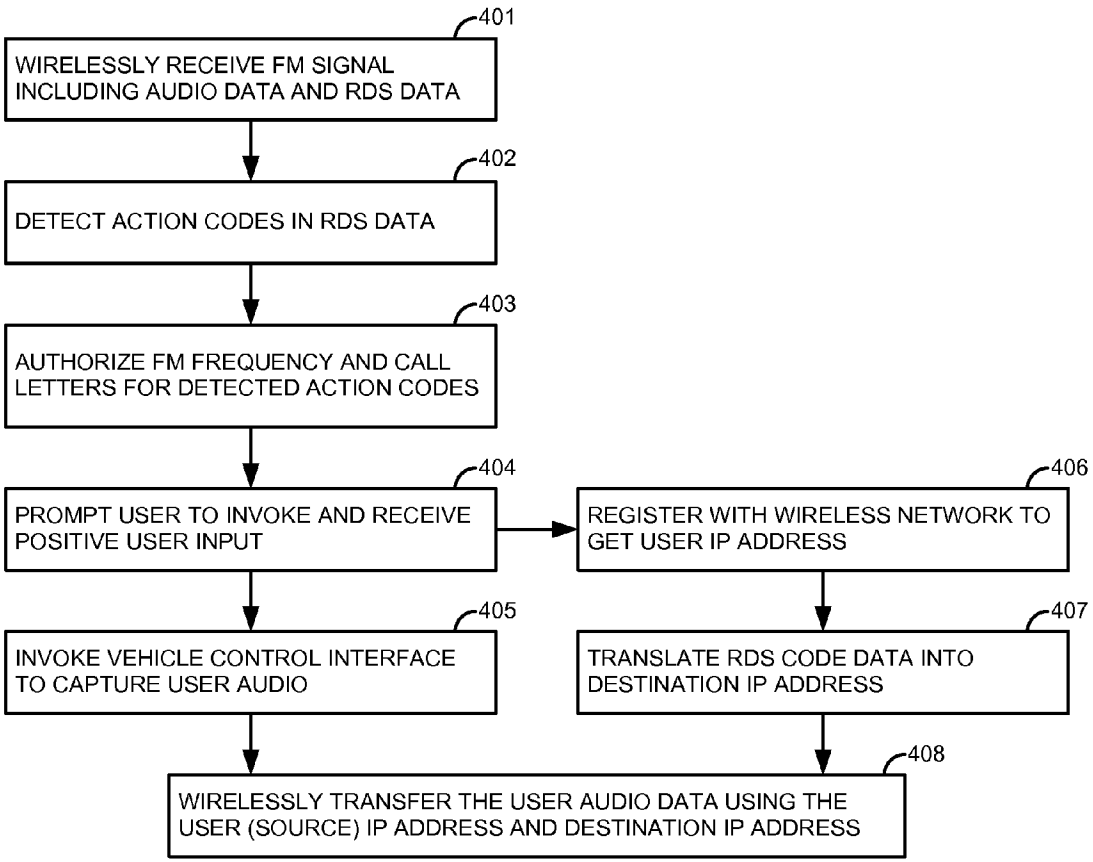
FIG. 4 illustrates the operation of a processing system to initiate wireless communications sessions based on FM RDS data.

FIG. 4 illustrates an exemplary operation of vehicle communication and control system 300 to initiate wireless communications sessions based on FM RDS data. Vehicle communication and control system 300 wirelessly receives an FM signal that includes both audio data and RDS data (401). Vehicle system 300 processes the RDS data from the FM signal to detect various different action codes (402). In response to detecting a particular action code (402), vehicle system 300 authorizes the FM station call letters in the RDS data and the FM frequency (403). For example, user and/or device settings may only allow the use of action codes from particular FM radio stations having particular call letters and/or frequencies.

If the action codes are authorized (403), vehicle system 300 prompts the user to invoke RDS-based control and receives a positive user input (404). The prompt and response might be audible, graphic, touch-based, or the like in a manner suitable for a vehicle operator to handle.

In response to the positive user input (404), vehicle system 300 invokes the vehicle control interface to capture spoken user data (405). In response to the positive user input (404), vehicle system 300 also registers with the wireless communication network and obtains an Internet Protocol (IP) address for the user (406). Vehicle system 300 also translates information from the RDS data into a destination IP address (407). The information may be call letters, frequency, text strings, action codes, and the like that system 300 converts into an associated domain name using an internal data structure. Vehicle system 300 may access a Domain Name Service (DNS) over the wireless communication session to translate the domain name into the destination IP address.

Vehicle communication and control system 300 then transfers the user audio data in IP packets using the user (source) IP address and the destination IP address to wireless communication network 330 for subsequent delivery to a remote server (408).

Figure 5:
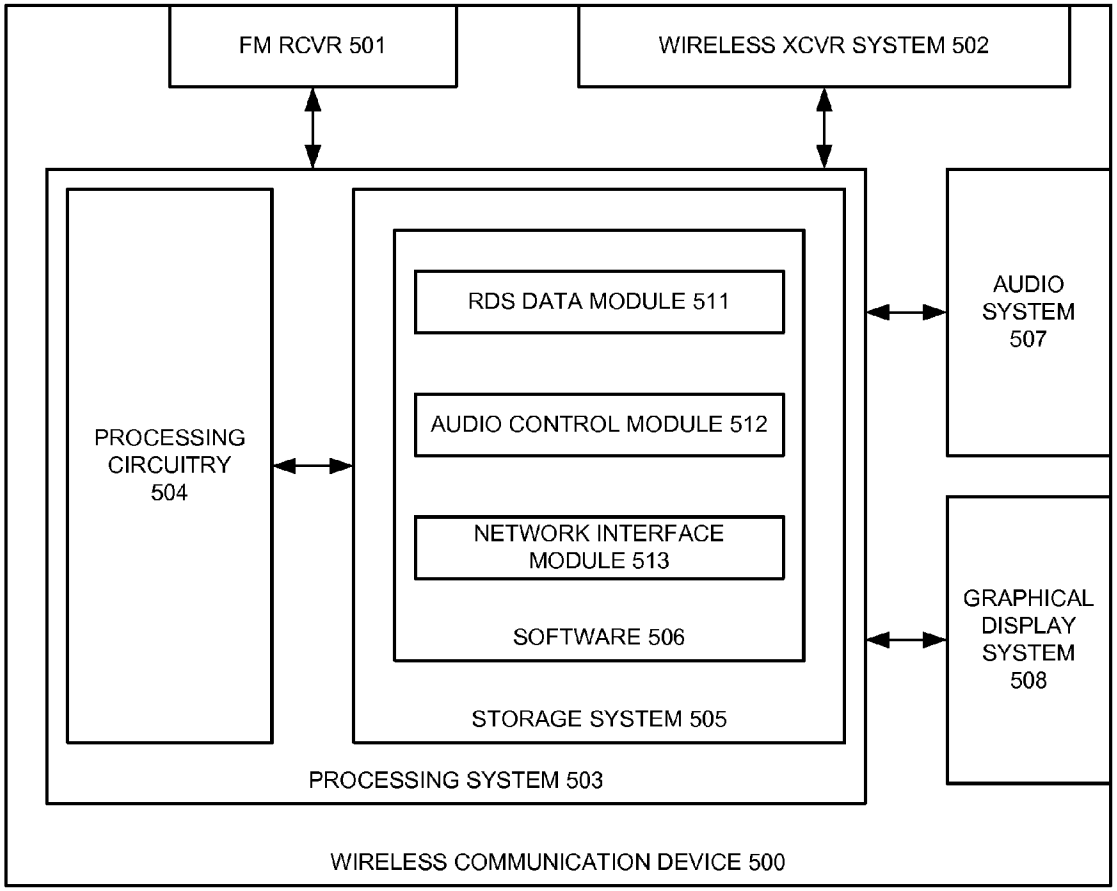
FIG. 5 illustrates a wireless communication device to initiate wireless communications sessions based on FM RDS data.

FIG. 5 illustrates a wireless communication device 500 to initiate wireless communications sessions based on FM RDS data. Wireless communication device 500 is an example of systems 100 and 300, although these systems may use alternative configurations. Wireless communication device 500 comprises FM receiver 501, wireless transceiver system 502, processing system 503, audio system 507, and graphical display system 508. Processing system 503 comprises processing circuitry 504 and storage system 505. Storage system 505 stores software 506. Some conventional aspects of wireless communication device 500 are omitted for clarity, such as power supplies, enclosures, and the like.

FM receiver 501 comprises communication components, such as antennas, filters, amplifiers, signal processing circuitry, memory, software, and the like. FM receiver 501 demodulates FM signals including both audio and RDS data.

Wireless transceiver system 502 comprises communication components, such as antennas, filters, amplifiers, signal processing circuitry, and the like. Wireless transceiver system 502 communicates over wireless communication networks as described herein.

Audio system 507 comprises speakers, microphones, and associated components to interact audibly with the user.

Graphical display system 508 comprises a touch-screen, lights, and associated components to graphically and tactilely interact with the user.

Processing circuitry 504 comprises circuit boards that hold integrated circuitry and associated electronics. Storage system 505 comprises non-transitory, machine-readable, data storage media, such as flash drives, disc drives, memory circuitry, and the like. Software 506 comprises machine-readable instructions that control the operation of processing circuitry 504 when executed. Software 506 includes modules 511-513 and may also include operating systems, applications, utilities, databases, and the like. All or portions of software 506 may be externally stored on one or more storage media, such as flash drives, discs, servers, and the like.

When executed by processing circuitry 504, RDS data module 511 directs circuitry 504 to display RDS data, detect action codes in the RDS data, and translate the actions codes into executable processing instructions. When executed by processing circuitry 504, audio control module 512 directs circuitry 504 to audibly interact with the user to obtain spoken audio, permissions, and other user instructions. When executed by processing circuitry 504, network interface module 513 directs circuitry 504 to initiate wireless communication sessions and perform wireless IP communications.

The above description and associated figures teach the best mode of the invention. The following claims specify the scope of the invention. Note that some aspects of the best mode may not fall within the scope of the invention as specified by the claims. Those skilled in the art will appreciate that the features described above can be combined in various ways to form multiple variations of the invention. As a result, the invention is not limited to the specific embodiments described above, but only by the following claims and their equivalents.

What is claimed is:

1. A method of operating a wireless communication system, the method comprising:

wirelessly receiving a Frequency Modulation (FM) signal including audio data and RDS data;

audibly playing the audio data from the FM signal and graphically displaying at least a portion of the RDS data from the FM signal;

detecting one or more action codes in the RDS data from the FM signal;

storing user settings to only allow the use of the one or more action codes from user approved FM radio stations having particular radio station call letters or FM frequencies;

processing the FM signal to determine an FM frequency or radio station call letters of the FM signal;

determining whether the detected one or more action codes are received from a user-approved FM radio station by comparing the FM frequency or radio station call letters of the received FM signal to stored user settings; and in response to the determination that the one or more action codes are from a user-approved radio station, initiating a wireless communication session with a wireless communication network, audibly capturing user data, and wirelessly transferring the user data for delivery to a server over the wireless communication session.

2. The method of claim 1 wherein initiating the wireless communication session in response to the determination that the one or more action codes are from a user-approved radio station comprises presenting a user prompt in response to the determination that the one or more action codes are from a user-approved radio station, receiving a user input to the user prompt, and initiating the wireless communication session in response to the user input.

3. The method of claim 2 wherein presenting the user prompt and receiving the user input comprises presenting an audible user prompt and receiving an audible user input.

4. The method of claim 2 wherein presenting the user prompt and receiving the user input comprises displaying a graphical user prompt and receiving a touch-display user input.

5. The method of claim 1 wherein initiating the wireless communication session in response to the determination that the one or more action codes are from a user-approved radio station comprises obtaining a user IP address from the wireless communication network in response to the determination that the one or more action codes are from a user-approved radio station.

6. The method of claim 1 wherein wirelessly transferring the user data to the server over the wireless communication session in response to the determination that the one or more action codes are from a user-approved radio station comprises determining a server IP address based on the RDS data and transferring the user data for delivery to the server using the server IP address.

7. The method of claim 1 wherein audibly capturing the user data in response to the determination that the one or more action codes are from a user-approved radio station comprises initiating an audio control interface in a vehicle in response to the determination that the one or more action codes are from a user-approved radio station.

8. The method of claim 1 wherein wirelessly transferring the user data to the server over the wireless communication session in response to the determination that the one or more action codes are from a user-approved radio station comprises determining user location information and transferring the user location information along with the user data.

9. A wireless communication system comprising:

an FM receiver configured to wirelessly receive a Frequency Modulation (FM) signal including audio data and RDS data;

an audio user interface configured to audibly play the audio data from the FM signal and to graphically display at least a portion of the RDS data from the FM signal;

a processing circuit configured to detect one or more action codes in the RDS data from the FM signal, to store user settings to only allow the use of the one or more action codes from user approved FM radio stations having particular radio station call letters or FM frequencies, to process the FM signal to determine an FM frequency or radio station call letters of the FM signal, to determine whether the detected one or more action codes are received from a user-approved FM radio station by comparing the FM frequency or radio station call letters of the received FM signal to stored user settings, and in response to the determination that the one or more action codes are from a user-approved radio station, to initiate a wireless communication session with a wireless communication network, to direct the audio system to audibly capture user data, and to direct a wireless transceiver to transfer the user data to a server over the wireless communication session;

the audio user interface configured to capture the user data; and the wireless transceiver configured to transfer the user data to the server over the wireless communication session.

10. The wireless communication system of claim 9 wherein the processing system is configured to drive a presentation of a user prompt in response to the determination that the one or more action codes are from a user-approved radio station and to initiate the wireless communication session in response to the determination that the one or more action codes are from a user-approved radio station.

11. The wireless communication system of claim 10 wherein the audio system is configured to audibly present the user prompt and audibly receive the user input to the user prompt.

12. The wireless communication system of claim 10 further comprising a graphical display configured to graphically present the user prompt and touch-detect the user input to the user prompt.

13. The wireless communication system of claim 9 wherein:

the processing system is configured to direct the wireless transceiver to obtain a user IP address from the wireless communication network in response to the determination that the one or more action codes are from a user-approved radio station and direct the wireless transceiver to transfer the user data for delivery to the server over the wireless communication session using the user IP address;

the wireless transceiver is configured to obtain the user IP address from the wireless communication network and use the user IP address to transfer the user data.

14. The wireless communication system of claim 9 wherein:

the processing system is configured to determine a server IP address for the server in response to the determination that the one or more action codes are from a user-approved radio station and drive the transfer of the user data using the server IP address;

the wireless transceiver is configured to use the server IP address to transfer the user data for delivery to the server over the wireless communication session.

15. The wireless communication system of claim 9 wherein the processing system is configured to initiate an audio control interface in a vehicle in response to the determination that the one or more action codes are from a user-approved radio station.

16. The wireless communication system of claim 9 wherein:

the processing system is configured to determine user location information and drive a transfer of the user location information along with the user data in response to the determination that the one or more action codes are from a user-approved radio station;

the wireless transceiver is configured to transfer the user location information along with the user data for delivery to the server over the wireless communication session.

* * * * *